United States Patent [19]

Sawyer

[11] Patent Number: 4,466,237

[45] **Date of Patent: * Aug. 21, 1984**

[54] MIXED FIBER LENGTH YARN

[75] Inventor: Linda C. Sawyer, Morris, N.J.

[73] Assignee: Celanese Corporation, New York, N.Y.

[ * ] Notice: The portion of the term of this patent subsequent to May 24, 2000 has been disclaimed.

[21] Appl. No.: 431,990

[22] Filed: Sep. 30, 1982

Related U.S. Application Data

[60] Division of Ser. No. 216,915, Dec. 16, 1980, Pat. No. 4,384,450, which is a continuation of Ser. No. 66,216, Aug. 13, 1979, abandoned.

[51] Int. Cl.[3] ..... D02G 3/04; D02G 3/22

[52] U.S. Cl. ..... 57/254; 19/145.5; 57/253; 57/255; 57/256; 57/315; 428/401

[58] Field of Search ..... 428/357, 359, 362, 369, 428/224, 225, 364, 365, 397–401; 57/315, 5, 200, 206–208, 317, 328, 252–257, 224, 238, 239, 243–245, 391; 19/0.3–0.64, 145.5, 145.7, 150

[56] References Cited

U.S. PATENT DOCUMENTS

| | | | |
|---|---|---|---|
| 2,172,439 | 9/1939 | Dreyfus et al. | 57/254 |
| 2,260,229 | 12/1941 | Nutter et al. | 57/252 X |
| 2,271,184 | 1/1942 | Dreyfus | 57/255 X |
| 3,007,227 | 11/1961 | Moler | 57/254 X |
| 3,018,521 | 1/1962 | Harmon | 19/150 |
| 3,046,724 | 7/1962 | Ward | 57/254 |
| 3,157,021 | 11/1964 | Kitson et al. | 57/254 |
| 3,188,790 | 6/1965 | Hebeler | 57/256 X |
| 3,205,648 | 9/1965 | Lohrke | 57/206 |
| 3,293,110 | 12/1966 | Stine, Jr. et al. | 57/253 X |
| 3,335,466 | 8/1967 | Gorrafa | 57/254 X |
| 3,350,872 | 11/1967 | Gorrafa | 57/254 X |
| 3,371,475 | 3/1968 | Gorrafa | 57/256 |
| 3,587,220 | 6/1971 | Eggleston | 57/256 |
| 3,626,441 | 12/1971 | Freed | 57/200 |
| 3,686,850 | 8/1972 | Thomson | 57/315 |
| 3,822,543 | 7/1974 | Edagawa et al. | 57/315 X |
| 3,852,948 | 12/1974 | Ruddell et al. | 57/254 X |
| 3,913,309 | 10/1975 | Chiarotto | 57/256 X |
| 3,915,042 | 10/1975 | Laird | 83/341 |
| 3,965,664 | 6/1976 | Goetti et al. | 57/256 X |
| 4,006,277 | 2/1977 | Laird | 428/401 X |
| 4,041,690 | 8/1977 | Lambert, Jr. | 57/207 |
| 4,141,115 | 2/1979 | Fourne et al. | 19/0.6 |
| 4,384,450 | 5/1983 | Sawyer | 57/254 |

FOREIGN PATENT DOCUMENTS

| | | |
|---|---|---|
| 1041751 | 11/1978 | Canada . |
| 2106815 | 8/1971 | Fed. Rep. of Germany . |
| 2609386 | 9/1977 | Fed. Rep. of Germany . |
| 47-21263 | 6/1972 | Japan . |
| 48-41457 | 12/1973 | Japan . |
| 870017 | 6/1961 | United Kingdom . |
| 1030655 | 5/1966 | United Kingdom . |
| 1297649 | 11/1972 | United Kingdom . |
| 1404872 | 9/1975 | United Kingdom . |
| 1411824 | 10/1975 | United Kingdom . |
| 1466397 | 3/1977 | United Kingdom . |
| 294876 | 5/1971 | U.S.S.R. . |

OTHER PUBLICATIONS

Slyvakov, V., World Textile Abstracts, vol. 6, Oct. 15, 1975, p. P1290, Oct. 1975, Staple Cutting of Man-Made Fiber.

Timofeev, M. N., J. Textile Inst., 1960, vol. 51, Jun., p. A293, Choice of Staple Length.

Birenbaum, E. I., J. Textile Inst., 1961, vol. 52, Nov., p. A594, Choice of Staple Length.

Anon., Textilbetriets, 1978, vol. 96, No. 10, Oct., p. 27, Significance of Fiber Fineness.

Roder, H. L., Text. Res. J., 1958, vol. 28, pp. 819–839, Oct. 1958.

Vera, G., Textilia, 1971, vol. 47, No. 6, pp. 87–93, World Textile Abstracts, Oct. 1971.

Tikhomirova, A. I., Tech. Text. Ind. USSR, 1972, No. 6, pp. 79–81, Fiber Length as Factor in Yarn.

Non-Woven Fabric Technology, Noyes Data Corp., 1971, pp. 196–200.

DuPont Research Disclosure, No. 15503, Stretch Break Staple Fiber, Mar. 17, 1977.

Wegner, W., Reyon Zellwolle Chemiefasern, 1957, No. 10, pp. 700–706; No. 11, pp. 772–777; 1958, No. 6, pp. 432–433; No. 7, pp. 502–504; No. 8, pp. 587–596; No. 9, pp. 662–666.

"Synthetische Fasern-Herstellung und Verarbeitung", Franz Fourne (editor), Wissenschaftliche Verlagsgesellschaft, Stuttgart, pp. 390–391, (1964).

*Primary Examiner*—John Petrakes
*Attorney, Agent, or Firm*—Burns, Doane, Swecker & Mathis

[57] ABSTRACT

A novel synthetic yarn is disclosed which comprises fibers of different lengths (as specified). At least three groups of synthetic fibers are present in the yarn, with the synthetic fibers within each group being substantially uniform in length. The substantially uniform length of each group of synthetic fibers present in the yarn differs from the substantially uniform length of the synthetic fibers in the other groups. The use of such mixtures of fiber lengths in a synthetic yarn enables the yarn to exhibit physical characteristics such as high bulk which more closely resemble the characteristics of natural fiber-containing yarns. Fabrics having improved physical characteristics may also be produced from the novel synthetic yarns disclosed.

21 Claims, 8 Drawing Figures

100% cotton yarn

100% cotton fabric

100% polyester yarn
uniform fiber length
of 1½ inches

100% polyester fabric
100% uniform fiber
length of 1½ inches

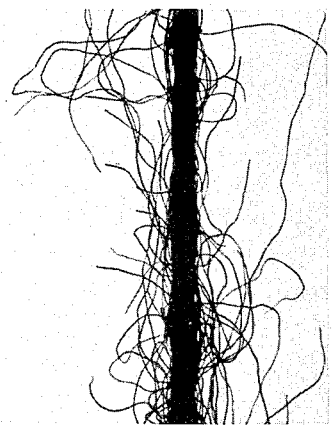

FIGURE 5
100% polyester yarn
mixed fiber length
19.4% $1\frac{1}{2}$ inches (by wt)
41.7% $1\frac{1}{4}$ inches
20.4% 1 inch
12.5% 3/4 inch
4.6% $\frac{1}{2}$ inch
1.4% $\frac{1}{4}$ inch

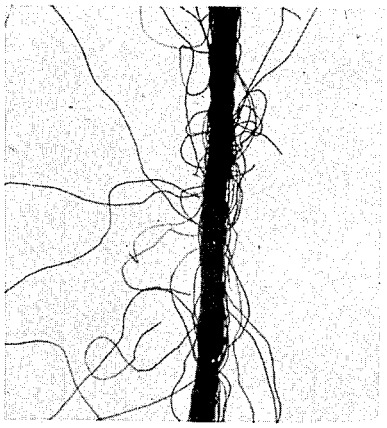

FIGURE 6
100% polyester yarn
mixed fiber length
20% $1\frac{1}{4}$ inches (by wt)
40% 1 inch
25% 3/4 inch
15% $\frac{1}{2}$ inch

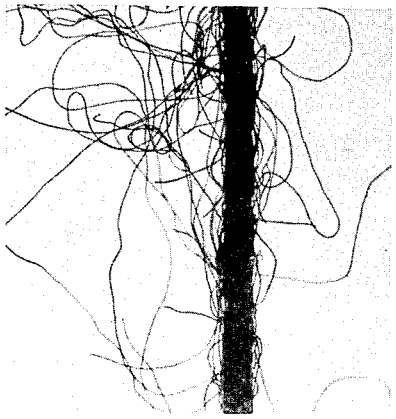

FIGURE 7
100% polyester yarn
mixed fiber length
50% $1\frac{1}{2}$ inches (by wt)
15% $1\frac{1}{4}$ inches
15% 1 inch
10% 3/4 inch
10% $\frac{1}{2}$ inch

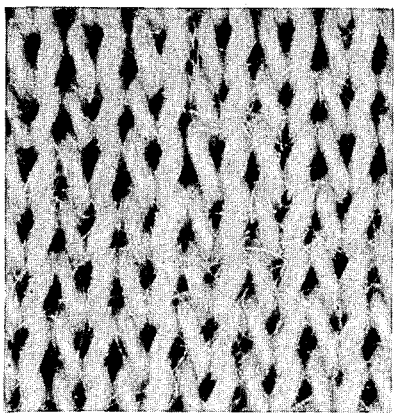

FIGURE 8
100% polyester fabric
mixed fiber length yarn
50% $1\frac{1}{2}$ inches (by wt)
15% $1\frac{1}{4}$ inches
15% 1 inch
10% 3/4 inch
10% $\frac{1}{2}$ inch

MIXED FIBER LENGTH YARN

This is a division of application Ser. No. 216,915, filed Dec. 16, 1980 now U.S. Pat. No. 4,384,450, which is a continuation of application Ser. No. 66,216 filed Aug. 13, 1979, now abandoned.

BACKGROUND OF THE INVENTION

The present invention relates to synthetic fiber-containing yarns, especially novel yarns comprised of synthetic fibers having different lengths.

For many years natural fibers such as cotton and wool have been replaced, either wholly or in part, by synthetic fibers in the manufacture of yarns and fabrics. Significant improvements in the strength and processability of textile yarns have thus been achieved.

Synthetic fiber-containing yarns and fabrics do not, however, typically possess the appearance and physical characteristics of cotton or wool yarns and fabrics. Synthetic fiber-containing fabrics also do not generally attain the same level of comfort as natural fiber-containing fabrics.

Attempts have thus been made to improve the physical characteristics of synthetic fiber-containing yarns and fabrics. For example, U.S. Pat. No. 3,350,872 describes a textile yarn comprised of synthetic fibers whose physical characteristics are intended to simulate those of a wool fabric, which yarn consists of a crimped and uncrimped acrylic fiber. U.S. Pat. No. 3,965,664 describes a yarn which is formed from a mixture of synthetic fibers including fibers having at least three different titers (titer substantially corresponds to denier) and which is intended to have the feel of a natural fiber-containing yarn. U.S. Pat. No. 3,188,790 discloses yarns comprised of a blend of synthetic fibers (e.g., nylon or polyethylene terephthalate) and cotton fibers, with the synthetic fibers being both crimped and uncrimped. U.S. Pat. Nos. 3,587,220 and 3,686,850 disclose yarns comprised of synthetic fibers having high and low shrinkage characteristics. U.S. Pat. No. 2,271,184 describes a yarn comprising of mixture of irregular length staple fibers of uniform denier along their individual lengths and staple fibers having a varying denier along their length, which staple fibers may also be blended with natural fibers. Differential fiber length is also a criterion taken into account in U.S. Pat. Nos. 3,157,021; 3,371,475; and 3,335,466 in order to produce a bulky, high strength synthetic yarn.

A synthetic fiber-containing yarn has not been produced, however, which adequately exhibits the advantageous physical characteristics (e.g., bulkiness and appearance) of natural fiber-containing yarns. A synthetic fiber-containing yarn having such characteristics while also possessing the strength and durability of synthetic fiber-containing yarns would thus be highly desirable. In addition, a fabric comprised of such a yarn would similarly possess characteristics such as increased cover heretofore unattained by conventional synthetic fabrics. Such fabrics and yarns would have widespread application in shirting, underwear, sheeting, home furnishings, as well as in miscellaneous textile uses.

OBJECTS AND SUMMARY OF THE INVENTION

It is an object of this invention to provide a synthetic fiber-containing yarn which possesses some of the physical characteristics of natural fiber-containing yarns.

It is also an object of this invention to provide a synthetic fiber-containing yarn which exhibits increased bulk.

It is further an object of this invention to provide a synthetic fiber-containing yarn which possesses some of the physical characteristics of cotton or wool fiber-containing yarns.

It is still further an object of this invention to provide a textile fabric comprised of a synthetic fiber-containing yarn which possesses some of the physical characteristics of natural fiber-containing fabrics such as cotton.

It is additionally an object of this invention to obviate or substantially eliminate the disadvantages of the prior art as outlined above.

In one aspect of the present invention there is provided an improved synthetic fiber-containing yarn comprised of a blend of synthetic fibers of different lengths wherein the synthetic fibers present in the yarn comprise at least about 50 percent by weight of the fibers within said yarn and consist of a mixture of at least three groups of synthetic fibers, each group consisting of fibers of a substantially uniform length which differs from the substantially uniform length of the synthetic fibers in the other groups, and wherein the fibers contained within said at least three groups of synthetic fibers are distributed among each of the following ranges based upon the weight of the fibers in the at least three groups:

(a) up to about 75 percent by weight of fibers having a length of about X, wherein X represents the length of the longest synthetic fiber in said groups;

(b) up to about 75 percent by weight of fibers having a length greater than about $\frac{1}{2}$X up to but not including said length of about X; and (c) up to about 35 percent by weight of fibers having a length less than or equal to said length of about $\frac{1}{2}$X.

In another aspect of the present invention, there is provided an improved fabric containing a synthetic fiber-containing yarn which is comprised of a blend of synthetic fibers of different lengths wherein the synthetic fibers present in the yarn comprise at least about 50 percent by weight of the fibers within said yarn and consist of a mixture of at least three groups of synthetic fibers, each group consisting of synthetic fibers of a substantially uniform length which differs from the substantially uniform length of the synthetic fibers in the other groups, and wherein the fibers contained within said at least three groups of synthetic fibers are distributed among each of the following ranges based upon the weight of the fibers in the at least three groups:

(a) up to about 75 percent by weight of fibers having a length of about X, wherein X represents the length of the longest synthetic fiber in said groups;

(b) up to about 75 percent by weight of fibers having a length greater than about $\frac{1}{2}$X up to but not including said length of about X; and (c) up to about 35 percent by weight of fibers having a length less than or equal to said length of about $\frac{1}{2}$X.

BRIEF DESCRIPTION OF THE DRAWINGS

FIG. 5 is a photograph of a yarn comprised of polyethylene terephthalate fibers of mixed length according to the present invention (20× magnification).

FIG. 6 is a photograph of a yarn comprised of polyethylene terephthalate fibers of mixed length according to the present invention (20× magnification).

FIG. 7 is a photograph of a yarn comprised of polyethylene terephthalate fibers of mixed length according to the present invention (20× magnification).

FIG. 8 is a photograph of a fabric produced from a yarn according to the present invention comprised of polyethylene terephthalate fibers of mixed length (20× magnification).

DETAILED DESCRIPTION OF THE INVENTION

The novel yarns of this invention are comprised of a blend of synthetic fibers of different lengths, wherein the synthetic fibers present in the yarn comprise at least about 50 percent by weight of the fibers within the yarn and consist of a mixture of at least three groups of synthetic fibers, each group consisting of synthetic fibers of a substantially uniform length which differs from the substantially uniform length of the synthetic fibers in the other groups, and wherein the fibers contained within said at least three groups of synthetic fibers are distributed among each of the following ranges based upon the weight of the fibers in the at least three groups:

(a) up to about 75 percent by weight of fibers having a length of about X, wherein X represents the length of the longest synthetic fiber in the groups;

(b) up to about 75 percent by weight of fibers having a length greater than about ½X up to but not including said length of about X; and (c) up to about 35 percent by weight of fibers having a length less than or equal to said length of about ½X.

A preferred distribution of synthetic fibers within the above ranges consists of between about 25 and about 50 percent by weight of synthetic fibers having a length of about X, between about 25 and about 50 percent by weight of synthetic fibers having a length greater than about ½X up to but not including said length of about X, and up to about 30 percent by weight of synthetic fibers having a length less than or equal to said length of about ½X. Most preferably the yarn contains less than about 20 percent by weight of synthetic fibers having a length less than or equal to said length of about ½X.

It has been found that yarns which contain synthetic fibers in these lengths and proportions possess characteristics closely paralleling those of natural fiber-containing yarns (e.g., cotton or wool yarns). These characteristics relate to aesthetic factors as well as to the thermal and tactile comfort of fabrics containing such yarns.

Figure 1:
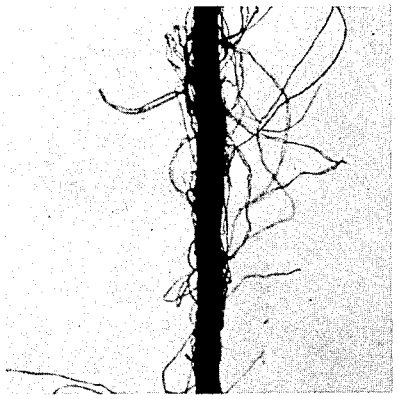
FIGURE 1 Prior Art
FIG. 1 is a photograph of a yarn comprised of cotton fibers (20× magnification).

Fabrics containing yarns comprised of natural fibers such as cotton generally exhibit "comfort" characteristics which are superior to those exhibited by fabrics which contain conventional synthetic fiber-containing yarns. Generally, natural fiber-containing yarns exhibit a greater bulk density than synthetic yarns (i.e. the yarns consist of loosely packed fibers). Natural fiber-containing yarns consist of a mixture of fibers of differing length, thus providing a yarn having a multitude of protruding ends along the longitudinal axis of the yarn. The multitude of protruding ends provided by such a fiber length distribution is clearly shown in the photograph of a cotton yarn denoted as FIG. 1. This characteristic of natural fiber-containing yarns is due, among other factors, to the differential length characteristics of the individual fibers within the yarn.

Figure 2:
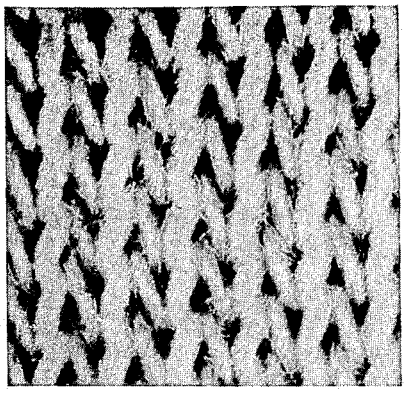
FIGURE 2 Prior Art
FIG. 2 is a photograph of a fabric produced from a conventional cotton yarn (20× magnification).

The high bulk density of natural fiber-containing yarns enables fabrics to be produced which exhibit low air permeability and satisfactory covering characteristics. The high degree of fiber end protrudence also enhances the comfort of the fabric. A typical cotton fabric is shown in the photograph denoted in FIG. 2.

Figure 3:
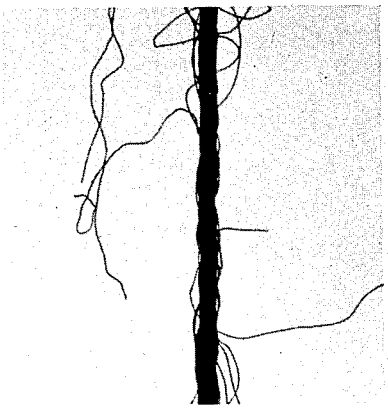
FIGURE 3 Prior Art
FIG. 3 is a photograph of a yarn comprised of uniform length polyethylene terephthalate fibers (20× magnification).
Figure 4:
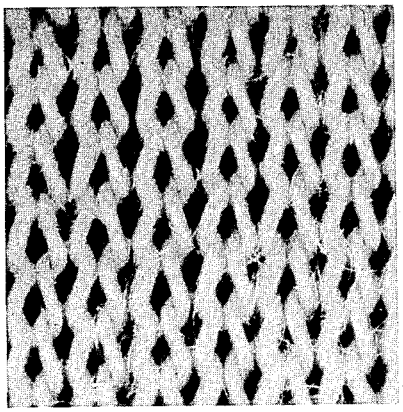
FIGURE 4 Prior Art
FIG. 4 is a photograph of a fabric produced from a conventional polyester yarn (20× magnification).

The significant degree of protrudence of fiber ends from the yarn in such fabrics provides for greater tactile comfort in comparison to conventional synthetic yarn-containing fabrics. Conventional synthetic yarns typically consist of fibers having a uniform length, therefore providing a lessened amount of protruding ends resulting in a smoother tactile sensation, high degree of air permeability, and low bulk. Note, for example, the low degree of protruding ends exhibited by a conventional polyethylene terephthalate yarn consisting of uniform fiber lengths shown in FIG. 3. Fabrics produced from such yarns provide less cover than conventional cotton fabrics. Note, for example, the decreased cover exhibited by the conventional polyester fabric shown in FIG. 4 in comparison to the cotton fabric of FIG. 2. In contrast thereto, compare the high degree of fiber end protrudence exhibited by the mixed fiber length polyethylene terephthalate yarns of this invention as shown in FIGS. 5, 6, and 7. Fabrics produced from the mixed synthetic fiber length yarns of the present invention will accordingly provide greater cover as shown in the photograph denoted as FIG. 8.

The novel synthetic fiber-containing yarns and fabrics of the present invention thus more nearly simulate natural fiber-containing yarns and fabrics, while additionally exhibiting the advantageous characteristics of synthetic fiber-containing yarns. Such advantages are provided by the use of synthetic fibers of specified lengths and in specific proportions in the production of the yarn, and eventually, in the synthetic fabrics produced therefrom.

The yarns of this invention contain at least three groups of synthetic fibers with the synthetic fibers within each group being of substantially the same length. It is recognized that the fiber lengths within each group will normally not be exactly the same due to the lack of precision which exists when large amounts of such fibers are cut, but the fiber lengths within each group will generally only differ by a factor of about 5 percent or less. For example, if the longest length X of the synthetic fibers in the groups is intended to be 3 inches, the group of fibers which is cut to that length will generally contain synthetic fibers differing from the desired 3 inch length by a factor of about plus or minus 5 percent or less. This group of fibers will, for purposes of the invention, be deemed to contain fibers of about 3 inches in length (i.e., a length of about X). Similarly, the phrase "about ½X" is intended to include lengths of ½X plus or minus about 5 percent. That is, if the longest length X of the synthetic fibers in the groups is intended to be 3 inches, then fibers having a length of about ½X will differ from a length of 1½ inches by only about plus or minus 5 percent.

The substantially uniform length of the synthetic fibers of each of the groups present in the yarn will also differ from the substantially uniform length of the synthetic fibers in the other groups present in the yarn. Generally it will be advantageous to employ groups of synthetic fibers whose substantially uniform lengths differ from the substantially uniform lengths of the synthetic fibers in the other groups by at least about 15 percent and preferably between about 15 percent and about 30 percent in order to provide a uniform and high degree of fiber end protrudence along the longitudinal axis of the yarn. It should be noted, however, that less significant differences between the substantially uniform lengths of the groups of synthetic fibers within the yarn will also provide the desired results, although the advantages of employing groups of synthetic fibers of differing lengths clearly diminish as the lengths of the synthetic fibers within the yarn become more nearly equal. Generally, the substantially uniform length of the synthetic fibers of each group should differ from the substantially uniform length of the synthetic fibers of the other groups by a factor of at least about 5 percent in order to ensure that the fiber lengths differ significantly enough to provide the desired results.

The synthetic fibers within the yarn must consist of a minimum of three groups of synthetic fibers in order to obtain the desired characteristics. More than three groups of synthetic fibers may be present as long as the lengths of all of the fibers present in the yarn are distributed in the required proportions. Generally, the actual lengths of the synthetic fibers are considered to be less important than the ratio of the lengths of the individual fibers to each other. However, yarn production considerations (e.g., the problems which arise from handling multiple lengths of fibers) discourage the use of an excessive number of groups of synthetic fibers of differing lengths. The advantages of the present invention may generally be achieved by employing anywhere from three to six groups of synthetic fibers of such lengths and in such proportions consistent with the required distribution of the synthetic fibers within the yarns of this invention. However, it may be desirable to have a wide distribution of lengths of fibers within each group.

In order to attain the full benefit of the yarn of the present invention, each of the groups of synthetic fibers contained in the yarn should be present in a significant amount. That is, each group should preferably comprise at least about 5 percent by weight of the total weight of the synthetic fibers contained within said groups. However, the percentage of synthetic fibers in any group may be less than about 5 percent by weight in certain instances, such as when more than three groups of synthetic fibers are present in the yarn. Note, for example, the proportions of the various groups employed in the yarn depicted in FIG. 5.

For purposes of illustration, the yarn of FIG. 5 contains six groups of fibers of different lengths ranging from about 1½ inches to about ¼ inch. The yarn contains 19.4 percent by weight (based on the synthetic fibers in the yarn) of fibers having a length of about X (i.e., X being 1½ inches which is the longest length of the synthetic fibers in the groups), 62.1 percent by weight of fibers having a length greater than about ½X (i.e., ¾ of an inch) and up to but not including said length of about X, and 18.5 percent by weight of fibers having a length less than or equal to said length of about ½X.

The different fiber lengths to be used within the groups present in the yarn can vary greatly depending upon the desired yarn characteristics as well as the intended use of the yarn. For example, textile fabrics whose primary use is in shirts and similar wearing apparel typically will be comprised of a yarn which contains synthetic fibers having a longest length of about 1½ inches. Yarns which are to be used in the production of sweaters, however, will typically contain synthetic fibers having a longest length of about 3 to 6 inches. The determination of the longest length to be used in a yarn which is intended for a specific use is well within the skill of the artisan.

Thus, in accordance with the required fiber distribution of the present invention, a yarn whose primary use lies in the shirting field could contain up to about 75 percent by weight of synthetic fibers of about 1½ inches in length, up to about 75 percent by weight of synthetic fibers having a length greater than about ¾ of an inch up to but not including said length of about 1½ inches, and up to about 35 percent by weight of synthetic fibers having a length less than or equal to said length of about ¾ of an inch, based upon the weight of the fibers in those three groups.

The synthetic fibers in each of the above ranges may be provided by more than one group of fibers, with the substantially uniform length of the synthetic fibers of one group differing from the substantially uniform length of the synthetic fibers of the other group. However, the total weight percentage of the synthetic fibers in the group must not exceed the allowable proportion for fibers of those lengths.

For example, in a yarn which contains 50 percent by weight of synthetic fibers of about 1½ inches in length, 40 percent by weight of synthetic fibers having a length greater than about ¾ of an inch and up to but not including said length of about 1½ inches, and 10 percent by weight of synthetic fibers having a length less than or equal to said length of about ¾ of an inch (based upon the weight of the fibers in those groups), the synthetic fibers having a length of between about ¾ and about 1½ inches could be evenly distributed between fibers 1 inch in length and fibers 1¼ inches in length (i.e., 20 percent by weight of each based on the total weight of the synthetic fibers present).

It should be understood that the length of the longest synthetic fibers to be used in the groups contained within the novel yarn of this invention may be much greater than 1½ inches, and may indeed be 3 or 6 inches or greater in length. Generally the length of the longest synthetic fiber will range between about 1 and 6 inches for conventional textile applications. However, the minimum length of the fibers present will necessarily be more closely controlled, since it may become very impractical to incorporate any fiber length of less than about ¼ inch in length into the yarn during the production sequence. The shortest length of any synthetic fibers present will thus generally be at least ½ inch.

The production of a synthetic fiber-containing yarn which contains synthetic fibers of lengths which vary over a wide range may also present problems during the production of the yarn. It is thus also advantageous to employ groups of synthetic fibers which have significantly differing lengths but which lengths do not differ too greatly. For example, a yarn containing synthetic fibers having lengths of about 3 inches, about 1¾ inches, and about ¾ of an inch would be acceptable both with respect to length differential among the groups as well as the minimum length present.

A preferred distribution of synthetic fibers within a yarn includes about 20 percent by weight of synthetic fibers of about 1¼ inches in length, about 40 percent by weight of synthetic fibers having a length ranging from about 1 up to but not including said length of about 1¼ inches, about 25 percent by weight of synthetic fibers having a length ranging from about ¾ up to but not including said length of about 1 inch, and about 15 percent by weight of synthetic fibers having a length less than said length of about ¾ inch (e.g., about ½ inch or less), based upon the weight of synthetic fibers present in the different groups.

A most preferred distribution of synthetic fibers within a yarn contains about 20 percent by weight of synthetic fibers of about 1¼ inches in length, about 40 percent by weight of synthetic fibers having a length of about 1 inch, about 25 percent by weight of synthetic fibers having a length of about ¾ of an inch and about 15 percent by weight of synthetic fibers having a length of about ½ of an inch. Such a yarn is shown in FIG. 6.

Other physical characteristics of the synthetic fibers used in the novel yarns of this invention may be varied in order to further increase the overall bulk of the yarn. For example, at least a portion of the synthetic fibers may be crimped prior to being incorporated into the yarn. Mixtures of shrinkable and non-shrinkable synthetic fibers may also be used to increase yarn bulk. At least a portion of the synthetic fibers may also have an irregularly-shaped or non-circular cross-section. Fibers of mixed deniers may also be used with the yarns of the present invention.

The synthetic fibers used in the novel yarns and fabrics of this invention may consist of any suitable conventional polymeric material. Suitable polymeric materials include cellulose acetate, rayon, polyamides (e.g., aramids), polyesters, acrylics, and polyolefins. Nylon 66 (e.g., poly(hexamethylene adipamide)), linear terephthalate polyesters (e.g., polyethylene terephthalate), polyacrylonitrile, polypropylene, and poly(metaphenylene isothalamide) are exemplary materials. Mixtures of the above materials may also be employed in the yarns of the present invention. Polyethylene terephthalate and cellulose acetate are preferred polymeric materials.

The synthetic fibers present in the yarn comprise at least about 50 percent by weight of the total fibers present in the yarn and consist of a mixture of at least three groups of synthetic fibers of substantially uniform length, with the synthetic fibers contained within the at least three groups being present in the required proportions in order to ensure that the benefits of the present invention are attained. Preferably, the synthetic fibers contained within the at least three groups are present in the yarn in amounts ranging from about 65 to 100 percent by weight based on the total weight of the fibers present in the yarn.

The yarns of this invention may also contain natural fibers such as cotton or wool fibers in conventional weight ratios which typically range from about 50:50 to 90:10 synthetic fiber/natural fiber, with preferred ratios being 65:35 and 80:20. It should be noted, however, that when the yarn contains both synthetic and natural fibers, the natural fibers need not be present in the required number of groups or the specified ranges set forth for the synthetic fibers. In addition, the yarn of this invention may also contain other synthetic fibers such as rayon or nylon instead of or in mixture with the natural fibers. Thus, for example, the yarn could comprise 65% mixed length polyester and 35% rayon or nylon.

The novel synthetic fiber-containing yarns of this invention may be formed into novel fabrics which exhibit improved comfort characteristics as compared to conventional synthetic fiber-containing fabrics. The fabrics may be produced by conventional processes (e.g., by knitting or weaving). Due to the increased bulk and protruding end count of the novel yarns of this invention, fabrics produced therefrom will exhibit improved covering characteristics as well as an improved tactile sensation. Such fabrics will therefore more closely possess the "look and feel" of natural fiber-containing fabrics, such as cotton and wool fabrics.

Fabrics may also be prepared which comprise a mixture of the novel synthetic fiber-containing yarns of the present invention and conventional natural fiber-containing yarns or synthetic fiber-containing yarns. The novel yarns of this invention may be blended with such natural or synthetic fiber-containing yarns in conventional weight ratios.

The yarns of this invention may be produced in any conventional manner. Any desired blending, carding, drafting and spinning sequence may be used to produce the yarns. When it is initially determined what distribution of synthetic fiber lengths is desired in the yarn to be produced, groups of synthetic fibers are cut on a cutting wheel set to the appropriate lengths. The cut fibers are then blended and carded whereupon the various lengths become randomly distributed. The yarn which is then spun from the mixture of fibers will contain the specified lengths of synthetic fibers in the required proportions. The fibers of each of the groups become randomly distributed and dispersed throughout the yarn during the yarn production process and are not actually grouped or segregated as to fiber lengths within the yarn which is produced.

In order to demonstrate the advantages to be gained from the present invention, several different yarns were prepared as set forth below:

TABLE 1

| Yarn | Yarn Composition |
|---|---|
| A | Polyethylene terephthalate fibers of uniform length (i.e. 1 ½ inches) |
| B | Conventional cotton fiber yarn |
| C | 50:50 blend of uniform length PET fibers/cotton fibers |
| D | Mixed PET fiber length yarn (i.e. 50% 1 ½ inches, 15% 1 ¼ inches, 15% 1 inch, 10% ¾ inch, 10% ½ inch) |

Fabrics prepared from each of the yarns A, B, C and D were tested using a Mitex Bending Tester to determine the bending rigidity of the yarns from which they were prepared. The bending rigidity of a yarn is indicative of how a fabric or garment containing that yarn will drape or hang from a person. The relative softness of a fabric is related to the bending rigidity of the yarn within the fabric, with a high value for bending rigidity being indicative of a high degree of fiber end protrudence within the yarn since the presence of protruding ends provides frictional resistence to bending.

Table II sets forth the bending rigidity for the various yarns identified above.

TABLE II

| Yarn | Bending Rigidity (millivolts/radian-inch) |
|---|---|
| A (Uniform length PET) | 3.5 |
| B (Cotton) | 9.6 |
| C (50:50 PET/Cotton) | 7.7 |
| D (Mixed fiber length) | 8.4 |

As may be seen from the above data, the cotton yarn exhibits the highest bending rigidity of the yarns tested. However, the mixed fiber length yarn which falls within the scope of the present invention (yarn D) exhibits a bending rigidity which is greater than that exhibited by any of the yarns except the cotton yarn. It is noted that the bending rigidity of the mixed fiber length yarn is significantly greater than the bending rigidity of the conventional polyethylene terephthalate yarn (i.e. yarn A).

The fabrics prepared from yarns A, B, C and D were further tested to determine certain other of their characteristics as set forth below:

TABLE III

| Fabric Make-Up | Fabric Thickness (In × $10^2$) | Fabric Weight (Oz/$yd^2$) | Fabric Bulk Area ($mm^2$/unit length) |
|---|---|---|---|
| Yarn A | 1.40 | 4.6 | 1.77 |
| Yarn B | 1.81 | 5.1 | 1.92 |
| Yarn C | 1.69 | 4.8 | 1.69 |
| Yarn D | 1.52 | 5.0 | 2.00 |

The above data shows that a fabric produced from a synthetic mixed fiber length PET yarn of the present invention (i.e. yarn D) exhibits a bulk area (i.e. a measure of yarn bulk including loops and hairs) which is greater than the bulk area of a cotton fabric produced from a conventional cotton yarn (i.e. yarn B). The bulk area measurements of Table III were made on a Quantimet 720 Image Analyzing Computer and consitute the average of over fifty measurements. The bulk area of the fabric produced from the mixed fiber length yarn of the present invention is significantly greater than the bulk area of the fabric produced from a conventional PET yarn (i.e. yarn A). Therefore, the fabric produced from yarn D, while having a thickness and weight that are not excessive, exhibits a significant increase in bulk area which is highly desirable since the bulk area of a fabric is directly related to the coverage to be afforded by that fabric per unit weight. That is, an increase in the bulk area of a fabric will result in an increase in the covering characteristics of the fabric.

In addition, fabrics produced from the mixed fiber length yarns of the present invention exhibit a water vapor transmission rate (WVTR) which is significantly lower than that exhibited by conventional synthetic fabrics while also approaching the values for cotton fabrics. The water vapor transmission rate is defined in accordance with ASTM test E96-66 and is indicative of the amount of water vapor which passes through a unit area of fabric per unit time at a vapor pressure difference of about 6.6 mm Hg at 70° F. and 65 percent relative humidity.

TABLE IV

| Fabric Makeup | Water Vapor Transmission Rate (gm/24 hrs/$m^2$) |
|---|---|
| Yarn A (Uniform length PET) | 2583 |
| Yarn B (Cotton) | 1620 |

TABLE IV-continued

| Fabric Makeup | Water Vapor Transmission Rate (gm/24 hrs/$m^2$) |
|---|---|
| Yarn D (Mixed fiber length) | 1923 |

The water vapor transmission rate of a fabric is indicative of the relative porosity and the covering characteristics of the fabric. That is, a fabric comprised of a yarn having a large number of protruding ends will necessarily be less porous than a fabric comprised of a yarn having a lesser number of protruding ends.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. In a yarn comprised of a blend of synthetic fibers of different length, the improvment wherein the synthetic fibers present in the yarn comprise at least about 50 percent by weight of the fibers within said yarn and consist of a mixture of at least three groups of synthetic fibers, each group consisting of synthetic fibers of a substantially uniform length such that the fiber lengths within each group differ by a factor of 5 percent or less, and which differs from the substantially uniform length of the synthetic fibers in the other groups by a factor of at least about 15 percent, and wherein the synthetic fibers contained within said at least three groups of synthetic fibers are distributed among each of the following ranges based upon the weight of the fibers present in said at least three groups:

(a) up to about 75 percent by weight of fibers having a length of about X, wherein X represents the length of the longest synthetic fiber in said groups;

(b) up to about 75 percent by weight of fibers having a length greater than about ½X up to but not including said length of about X; and (c) up to about 35 percent by weight of fibers having a length less than or equal to said length of about ½X.

2. The yarn of claim 1 wherein the synthetic fibers within said at least three groups are comprised of a polymeric material selected from the group consisting of linear terephthalate polyesters, cellulose acetate, acrylics, and polyamides.

3. The yarn of claim 2 wherein said polymeric material is polyethylene terephthalate.

4. The yarn of claim 1 wherein X ranges from about 1 to about 6 inches.

5. The yarn of claim 4 wherein X is about 6 inches.

6. The yarn of claim 4 wherein X is about 3 inches.

7. The yarn of claim 4 wherein X is about 1½ inches.

8. The yarn of claim 1 wherein at least a portion of said synthetic fibers within said at least three groups are crimped.

9. The yarn of claim 1 wherein at least a portion of said synthetic fibers within said at least three groups have an irregularly-shaped or non-circular cross-section.

10. The yarn of claim 1 wherein the synthetic fibers within said at least three groups are distributed among each of the following ranges:

(a) between about 25 and about 50 percent by weight of fibers having a length of about X;

(b) between about 25 and about 50 percent by weight of fibers having a length greater than about ½X up to but not including said length of about X; and (c) up to about 30 percent by weight of fibers having a length less than or equal to said length of about ½X.

11. The yarn of claim 10 wherein said synthetic fibers having a length less than or equal to said length of about ½X are present in an amount of less than about 20 percent by weight.

12. The yarn of claim 1 wherein said length of about X is about 1¼ inches and the synthetic fibers within said at least three groups are distributed as follows:

(a) about 20 percent by weight of fibers having a length of about 1¼ inches;

(b) about 40 percent by weight of fibers having a length ranging from about 1 inch up to but not including said length of about 1¼ inches;

(c) about 25 percent by weight of fibers having a length ranging from about ¾ of an inch up to but not including said length of about 1 inch; and (d) about 15 percent by weight of fibers having a length less than said length of about ¾ of an inch.

13. The yarn of claim 12 wherein the synthetic fibers within said at least three groups are distributed as follows:

(a) about 20 percent by weight of fibers having a length of about 1¼ inches;

(b) about 40 percent by weight of fibers having a length of about 1 inch;

(c) about 25 percent by weight of fibers having a length of about ¾ of an inch; and (d) about 15 percent by weight of fibers having a length of about ½ of an inch.

14. The yarn of claim 1 wherein the substantially uniform length of the synthetic fibers within each of the at least three groups present in the yarn differs from the substantially uniform length of the synthetic fibers in the other groups by a factor of between about 15 percent and about 30 percent.

15. The yarn of claim 1 wherein the yarn additionally comprises natural fibers.

16. The yarn of claim 15 wherein said natural fibers are selected from the group consisting of cotton fibers and wool fibers.

17. The yarn of claim 1 wherein the fibers within said at least three groups comprise at least about 65 percent by weight of the fibers present in the yarn.

18. The yarn of claim 17 wherein the fibers within said at least three groups of fibers comprise 100 percent by weight of the fibers present in the yarn.

19. A fabric containing the yarn of claim 1.

20. The yarn of claim 1 wherein the yarn additionally comprises natural fibers, other synthetic fibers or mixtures thereof.

21. The yarn of claim 20 wherein said natural fibers are selected from the group consisting of cotton fiber and wool fiber and said synthetic fibers are selected from the group consisting of cellulose acetate, rayon, acrylics and polyamides.

* * * * *